US005975364A

United States Patent [19]

Kaufman

[11] Patent Number: 5,975,364

[45] Date of Patent: Nov. 2, 1999

[54] DISPENSER HAVING DUAL CONTAINERS

[75] Inventor: John G. Kaufman, Burlington, Canada

[73] Assignee: Kaufman Products Inc., Oakville, Canada

[21] Appl. No.: 08/720,108

[22] Filed: Sep. 27, 1996

[51] Int. Cl.[6] ..... B65D 37/00

[52] U.S. Cl. ..... 222/129; 222/207

[58] Field of Search ..... 222/94, 207, 212, 222/129, 215, 457

[56] References Cited

U.S. PATENT DOCUMENTS

| | | | |
|---|---|---|---|
| 2,959,327 | 11/1960 | Bloom | 222/94 |
| 3,347,420 | 10/1967 | Donoghue | 222/207 X |
| 4,324,349 | 4/1982 | Kaufman | 222/207 |
| 4,516,697 | 5/1985 | Dreps et al. | 222/207 X |
| 4,635,828 | 1/1987 | Kaufman | 222/185 |
| 4,645,097 | 2/1987 | Kaufman | 222/207 |
| 4,893,729 | 1/1990 | Iggulden | 222/42 |
| 4,993,595 | 2/1991 | Bertram et al. | 222/129 |
| 5,033,653 | 7/1991 | Kaufman | 222/185 |
| 5,060,830 | 10/1991 | Krall | 222/207 X |
| 5,217,147 | 6/1993 | Kaufman | 222/185 |
| 5,269,441 | 12/1993 | O'Meara | 222/94 |
| 5,346,097 | 9/1994 | Melland et al. | 222/132 |
| 5,427,279 | 6/1995 | Kaufman | 222/207 |
| 5,590,817 | 1/1997 | Kaufman | 222/207 X |

FOREIGN PATENT DOCUMENTS 2 628 076 8/1989 France .

*Primary Examiner*—Kenneth Bomberg
*Attorney, Agent, or Firm*—Rogers & Scott

[57] ABSTRACT

The invention provides a dispenser for dispensing one or two liquids simultaneously. For two liquids the dispenser has a pair of inverted containers defining bottom openings with the containers arranged in side-by-side relationship. A base is sealingly attached to the containers and has two reservoirs and associated dispensing openings. The arrangement is such that liquid from the containers will pool in the reservoirs below the dispensing outlets creating a condition of equilibrium in the containers. When the user disturbs the equilibrium, liquids from both containers flow out through the respective dispensing outlets for mixing in use, and then after dispensing air, flows into the dispenser to replace dispensed liquid thereby allowing equilibrium to again be established.

When the invention is used for dispensing a single liquid, one container contains liquid and the second container is squeezed to disturb the equilibrium and cause dispensing.

11 Claims, 3 Drawing Sheets

DISPENSER HAVING DUAL CONTAINERS

FIELD OF THE INVENTION

This invention relates to dispensers for liquids which dispense in response to a force applied to disturb an equilibrium condition in the dispenser. More particularly the invention relates to such a dispenser having two containers which can be adapted to dispense a single liquid or two different liquids simultaneously.

BACKGROUND OF THE INVENTION

It is common to supply household liquids in containers sized for ease of handling. Some containers include structure which permits dispensing rather than pouring and these structures commonly involve some form of pump action. Because the containers are disposable, it is becoming more common for manufacturers to attempt to make the containers recyclable. However, pumps generally have numerous parts made from materials as diverse as stainless steel, rubber and various thermoplastic and thermohardening plastics. Consequently, pumps are becoming less acceptable.

A second difficulty with pump structures is cost and, although very efficient manufacturing methods keep the cost to an accepted level, there is no easy way of adapting pump technology to dispense more than one liquid at once without eventually doubling the cost of the pump parts.

This latter difficulty has been one of the key factors in limiting sales of product made up of two components which are to be kept separate until dispensed simultaneously. Such two-part products are not suitable for sale in containers which are used by simply pouring because of the inaccuracies of this procedure. There is therefore a need for a two-part dispenser having a simple structure and which is readily made without the complexities of a pump. It would be a benefit if such a dispenser could be designed to be made from materials which would permit all of it to be recycled without tedious dismantling and sorting of materials.

This invention also addresses another shortcoming of inverted liquid dispensers of the type which dispense in response to a squeezing action on the container. Typically the dispenser will provide the most liquid for a given squeeze when the dispenser contains the most liquid. As the amount of liquid decreases the dispenser contains more air and the compressibility of the air affects the amount of liquid dispensed.

This invention will also provide embodiments which are significantly less affected as the volume of liquid in the container is reduced.

SUMMARY OF THE INVENTION

The invention provides a dispenser having a pair of inverted containers defining bottom openings. The containers are in side-by-side relationship and sealingly attached to a base which preferably has two reservoirs and associated dispensing openings. The arrangement is such that liquid from the containers will pool in the reservoirs below the dispensing openings creating a condition of equilibrium in the containers. When the user disturbs the equilibrium, liquids from both containers flow out through the respective dispensing openings, and then after dispensing, air flows into the dispenser to replace dispensed liquids thereby allowing equilibrium to again be established.

Another embodiment provides liquid in one container and the second container is squeezed to disturb the equilibrium and cause dispensing as the user tilts the dispenser to cause flow of reservoir liquid to an associated dispensing opening.

DESCRIPTION OF THE PREFERRED EMBODIMENT(S)

Figure 1:
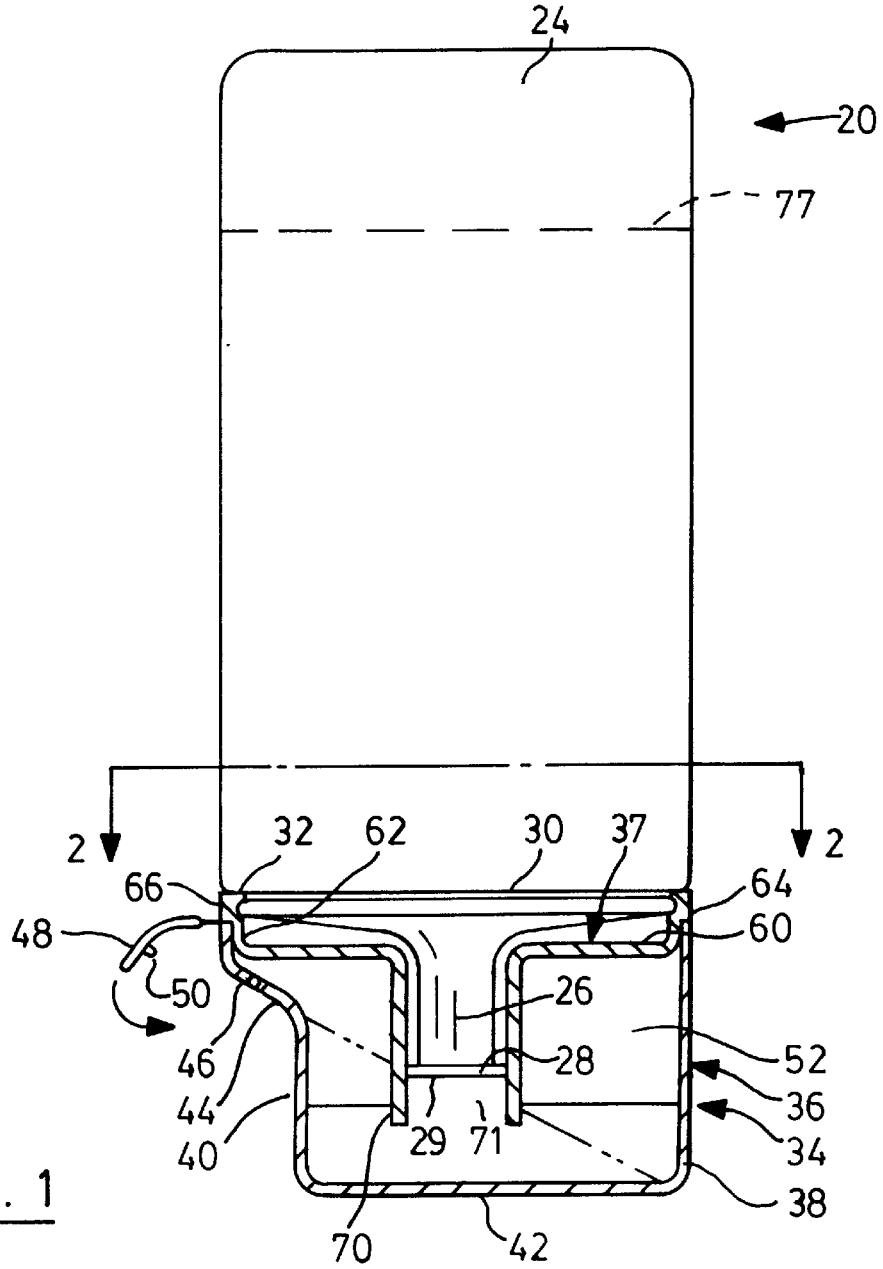
FIG. 1 is a side view of a preferred embodiment of the invention for dispensing two liquids simultaneously and including a base sectioned along a break indicated at 1—1 of FIG. 2 and showing internal parts of the dispenser.

Reference is first made to FIG. 1 to generally describe the arrangement of a dispenser indicated generally by the numeral 20. This figure is useful in understanding the operation but it is necessary to refer to FIGS. 2 and 3 in order to understand that the dispenser is made up of two containers 22, 24 and that because FIG. 1 is a side view, only container 24 can be seen in FIG. 1. As will become apparent from subsequent description, the operation of the dispenser 20 is such that both containers 22 and 24 are made to operate simultaneously. The operation of container 24 will be described generally with reference to FIG. 1 and the combination of the two containers will then be described.

As seen in FIG. 1, the container 24 has a bottom opening neck 26 terminating in a collar 28 defining an outlet 29. As will be described more fully later, the container 24 defines a peripheral recess 30 adjacent the neck 26 to receive a rib 32 defined at the upper extremity of a base 34 to connect the base to the bottle.

The base 34 is made up of a cup-shaped receptacle 36 and an insert 37. The receptacle 36 has a peripheral side wall 38 which matches the general contour defined by the two containers 22, 24 and which defines a local recess 40 which extends vertically and has a cross-sectional shape seen in ghost outline in FIG. 2. The peripheral side wall 38 extends generally longitudinally of the dispenser and blends into a bottom wall 42 extending transversely and shaped to stand the dispenser on a horizontal surface.

The recess 40 is defined in part by an angled portion 44 of the peripheral wall and this portion defines a dispensing outlet 46 through which liquid from the container 24 can be dispensed, as will be described. The opening 46 is associated with a simple flap closure 48 having a projection 50 for engagement in the opening to seal the opening. The closure is moulded as part of the insert 37 but could also be separate, or part of the receptacle 36. This will be described in detail after completing description of the receptacle 36 with reference to FIGS. 1 and 3.

Figure 3:
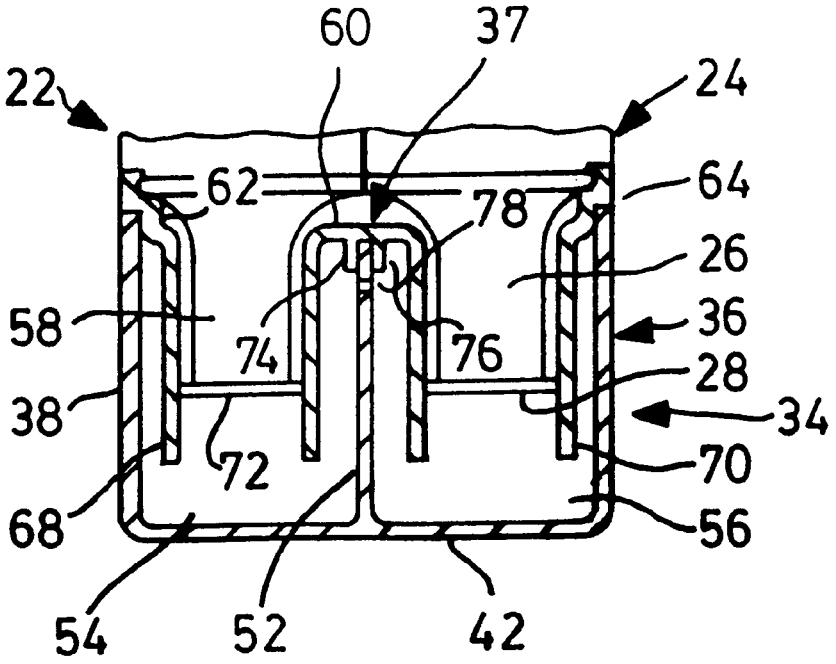
FIG. 3 is a sectional side view of a lower part of the dispenser including the base and taken on line 3—3 of FIG. 2.

As seen in FIG. 3, the receptacle 36 includes a central dividing wall 52 extending upwardly from the bottom wall 42 and, as seen in FIG. 1, meeting the peripheral side wall 38 to thereby define a pair of reservoirs 54, 56 for respectively receiving liquid from the containers 22, 24. It will be seen in FIGS. 1 and 3 that the neck 26 of container 24 and a corresponding neck 58 of container 22 project into these reservoirs.

The insert 37 shown in FIGS. 1 and 3 will now be described. As mentioned earlier, this insert forms part of the base 34 and includes a main portion 60 extending transversely and contained within a short upright wall 62 extending from the main portion 60. This wall is in locating contact inside the peripheral side wall 38 of the receptacle 36 and, at the top of the short upright wall 62, an outward step is formed to rest on the upper extremity of the side wall 38 to form a joint 64. Above the joint, the insert 37 includes an upright portion 66 which at its outer extremity is generally in alignment with the peripheral side wall 38 of the receptacle 36 and also with outer surfaces of the respective containers 22, 24. This upright portion 66 defines on its inner surface the rib 32 engaged in recess 30 which extends around both of the containers 22, 24.

The main portion 60 of the insert 37 also defines a pair of longitudinally extending tubes 68, 70 which are positioned to receive the respective necks 58 and 26 of the containers 22, 24. The collar 28 on container 24 is a sliding sealing fit within the tube 70 and a similar collar 72 is a sliding sealing fit within the tube 68.

The arrangement of the parts will be better understood with reference to the method of assembly. First of all, the receptacle 36 receives the insert 37 which slides into the receptacle to meet at the joint 64. This joint is sealed using any convenient method including adhesive, ultrasonic welding, etc. As mentioned earlier, the flap closure 48 is an integral part of the insert 37 and is connected by a living hinge so that on assembly, the flap closure can be rotated into sealing engagement with the dispensing outlet 46. Although not shown on the drawings, the flap closure 48 is in fact a pair of closures because the projection 50 must be repeated for a second dispensing outlet similar to the outlet 46 and associated with the reservoir 54 rather than the reservoir 56 shown in FIG. 1.

As the insert 37 is entered into the receptacle 36, the dividing wall 52 in the receptacle engages in a recess defined between a pair of ribs 74, 76 on the underside of the main portion 60 of the insert 37. The engagement must be such that there is a seal made to prevent accidental flow between the reservoirs 54, 56. This can be accomplished in a number of ways such as by using a force fit or creating an ultrasonic weld where the parts meet. As will be explained, some leakage may be desirable but is not essential and for the purposes of the description so far, it is to be assumed that there is no leakage between the two reservoirs.

The two containers 22, 24 are filled and then the base is assembled from above onto the containers. The containers can be similar even to the extent of having been moulded in the same mould and are held together by suitable adhesive or heat welded at the periphery where they meet. The result is an integral structure which is engaged into the assembled base 34 by pushing the necks 26 and 58 into the respective tubes 70 and 68. There will of course be some inevitable minor misalignment caused by shrinkage and tolerancing of such a structure but it is to be appreciated that the forms of the necks are chosen so that there will be flexibility sufficient to accommodate inaccuracy and yet provide seals within the tubes 68 and 70. The assembly is then such that the bottom ends of the tubes essentially form outlets 71 for the containers. It will be appreciated that this sealing arrangement could be varied and that the actual necks of the bottles could project beyond the tubes. In any event, there is an outlet for liquid from the containers and this outlet is located below the dispensing outlets 46 and near the bottom wall 42 for reasons which will be explained.

As the engagement of the containers takes place, the rib 32 on the inside surface of the upright portion 66 of the insert 37 will engage in the recess 30 to rigidify the structure. However this is not a seal in the sense that it is not intended to prevent air leakage because the necessary sealing for the operation of the dispenser takes place in the boundaries of the reservoirs 54, 56. In other words, there can be leakage above the insert 37 but not below it.

Next the assembled dispenser is inverted into the position shown in the drawings. As this happens the liquids will fall from the containers and into the reservoirs creating pools in the reservoirs until equilibrium is established as seen in FIG. 1. Normally the dispenser will stand on a horizontal surface and the user will pick it up by gripping the containers. It will be natural to use fingers and thumb to either side of the dispenser because it will be natural to position the outlet 46 for dispensing. The thumb and fingers will effectively be positioned on ends of the line 3—3 of FIG. 2. Further, the angled portion 44 of the side wall 38, the position of the outlet 46 will encourage the user to tilt the dispenser generally into a tilted position where the angled portion 44 is generally horizontal. This will be a natural action because the user will anticipate putting the container in a position where the dispensing outlet 46 faces downwardly. As the tilting action takes place, liquid will flow from the level shown in full outline in FIG. 1 to the ghost outline position. Almost simultaneously the user will naturally squeeze the resiliently deformable containers 22, 24 thereby disturbing the equilibrium and causing liquid to flow through the outlets at the bottom of the tubes 68, 70 thereby tending to create a pressure build-up in the reservoirs as the levels in the reservoirs rise. Liquids will then flow from the reservoirs through the dispensing outlets 46 driven by the build-up in pressure as the user continues to squeeze the dispenser. As soon as the user discontinues dispensing and puts the dispenser back in its normal position on a surface, the resiliency of the containers will draw air inwardly through the respective outlets 46 and into the reservoirs 54, 56. Some air will flow back into the containers 22, 24 until equilibrium is reestablished at a level similar to that shown in broken outline in FIG. 1 at 77.

It will be appreciated that the dispenser can accommodate some temperature variations. The equilibrium in the dispenses will be affected by an increase in ambient temperature resulting in some liquid flowing from the containers into the reservoirs and elevating the level of liquid in the reservoirs. No dispensing will take place however unless the temperature change is so extreme that the liquid are driven to the respective outlets 46. With suitable design the levels are chosen to ensure that in normal use no dispensing will take place. However, if the level is increased and the user then dispenses, the dispensing will take place primarily from the liquid in the reservoirs so that when air is sucked back into the reservoirs, it will tend to lower the levels in the reservoirs before any air finds its way back into the containers. Conversely, if after a higher temperature dispense, the ambient temperature drops, then the levels in the reservoirs will drop and some air could find its way into the containers to allow some liquid to fall into the reservoirs to re-establish a new equilibrium.

It will be appreciated that the actual dispensing from each of the containers 22, 24 will depend upon the relative deformation of these containers during dispensing. The design and materials are chosen so that in a normal use, both containers will deflect and cause dispensing. For many products, unequal dispensing from the containers would not be a major difficulty. However, where it is desired to make the dispensing more equal, then the embodiment described so far can be modified very simply to provide more equal dispensing. The simplest form of such a modification is seen in FIG. 3 where a very equalizing opening 78 is formed in the dividing wall 52 adjacent the ribs 74, 76. Consequently, if a user applies a greater deforming force to one of the containers than to the other, the result will be an imbalance in pressures in the reservoirs 54, 56. Because of the natural resistance of flow through the outlets 46, the tendency for a build up of different pressures in the reservoirs 54, 56 will be eliminated by air flow through the opening 78. For normal dispensing this will mean that essentially equal amounts of liquid will dispense from each of the reservoirs 54, 56 (providing of course the dispensing openings 46 are similar) and suck back will equalize between the two reservoirs in the same way. Although there may be some variations in amounts dispensed from the reservoirs, the dispensing will be essentially equal and both containers will empty at substantially the same time within reasonable allowances.

Figure 4:
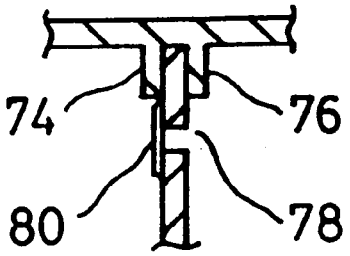
FIG. 4 is a view similar to FIG. 3 and showing a part incorporating another embodiment, the figure being to a larger scale than FIG. 3.
Figure 5:
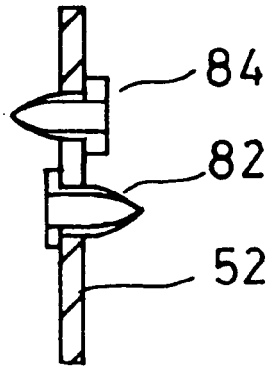
FIG. 5 is a view similar to FIG. 4 and showing yet another embodiment.

It may be desirable to have the equalizing opening 78 valved in order to maintain it closed except during dispensing. One approach to such an arrangement is shown in FIG. 4 where a flap 80 is formed with a living hinge as an extension of the rib 74. A similar flap from the rib 76 and on the opposite side of a different opening would be provided to allow flow in the opposite direction. Another arrangement is shown in FIG. 5. In this case, the dividing wall 52 has openings which respective one way valves 82, 84 arranged to permit flows in opposite directions. The valves are very flexible and are equipped with very small apertures which dilate upon applying flow pressure. Consequently the valves will remain closed until such time as dispensing takes place.

Figure 2:
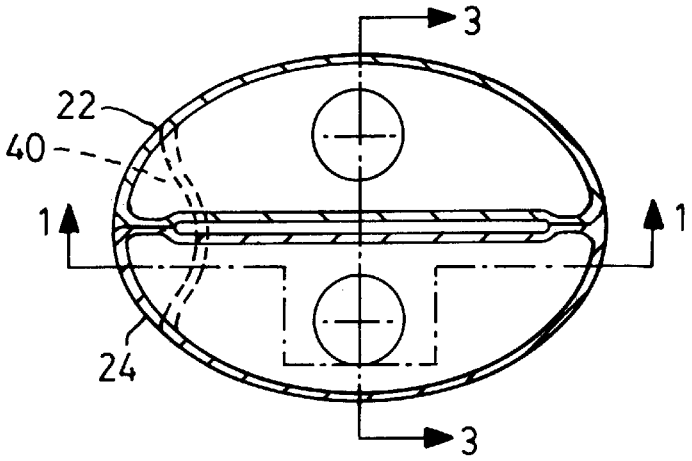
FIG. 2 is a sectional top view on line 2—2 of FIG. 1 and showing two containers.
Figure 6:
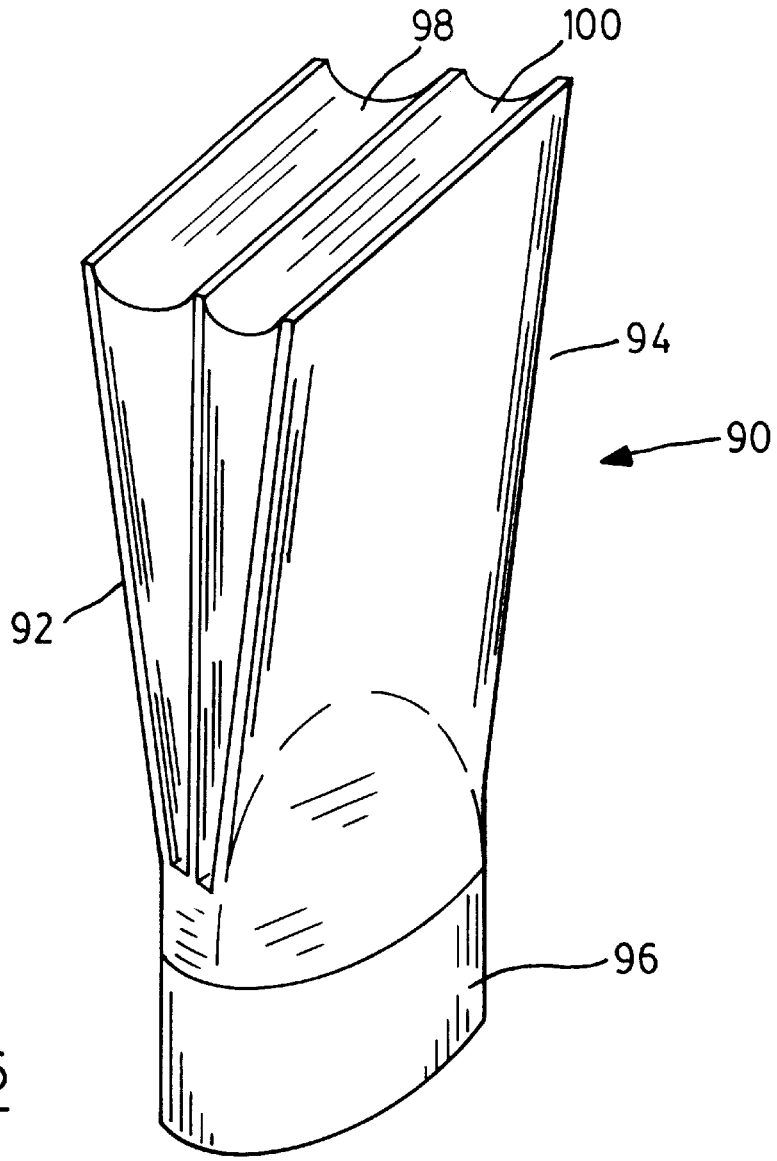
FIG. 6 is an isometric view of yet another embodiment.

Reference is next made to FIG. 6 which is a view similar to FIG. 2 and illustrating an alternative embodiment of the dispenser. As mentioned previously, the dispenser shown in FIGS. 1 and 2 would allow differential deflection of the resilient containers 22, 24 and this could lead to more dispensing coming from one container than the other.

One approach to resolving this would be to control the form of deflection of the containers. As seen in FIG. 6, a dispenser 90 has a pair containers 92, 94 on a base 96. The containers are relatively rigid but for flexible accordion pleats 98, 100. Consequently, when a user squeezes the dispenser, the containers will distribute the loads onto the pleats. Since the loads are equal and opposite (albeit applied unevenly by fingers and thumb) the containers will tend to displace the same amount of liquid.

Figure 7:
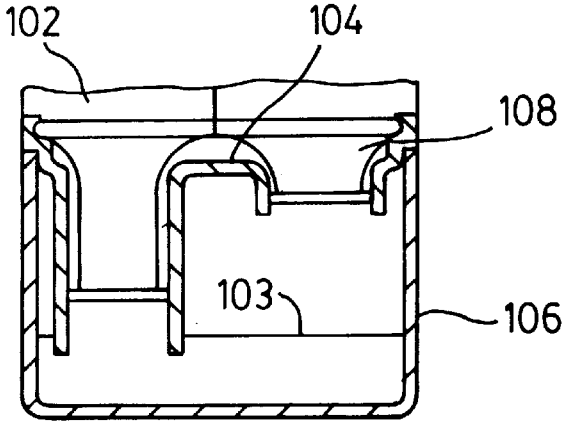
FIG. 7 is a view similar to FIG. 3 and illustrating still a further embodiment.

The foregoing embodiments have addressed the question of dual dispensing of two liquids simultaneously. However, a small variation in structure provides the embodiment shown in FIG. 7 which addresses a different problem, that is to provide a substantially constant dispense for a given squeeze. This will give a better feel to the action than that provided when the squeeze has to deform a container which is gradually emptying. This latter container will feel stiff when full of liquid and gradually become soft and unresponsive as air replaces the liquid. In FIG. 7 a container 102 is engaged in an insert 104 in similar fashion to the structure described with reference to FIG. 3. However, in this case a receptacle 106 has no divider so there is one reservoir containing liquid at a level 103.

A container 108 also engages in insert 104 but well above the liquid. The outlet from this container is therefore available only to push air into the base. As a result the container 102 can be rigid because on squeezing the dispenser the container 108 will deflect the same every time and cause dispensing by pressurizing the reservoir. Of course the air would simply leave the dispenser if the dispenser was not tilted as described with reference to FIG. 1.

The action is such that dispensing is unaffected by the volume of liquid in the container 102.

It should also be noted that the dividing wall 52 shown in FIG. 3 could be used with a container 108 if the insert were modified to receive container 108 in the manner shown in FIG. 7. Air would then flow from the container 108, through equalizing opening 78 and thereby cause dispensing.

Other variations are within the scope of the invention. For instance the embodiment shown in FIGS. 1 to 3 could be varied by having a limp section in the dividing wall 52 with sufficient material to allow the wall to move (as indicated in ghost outline) to accommodate some pressure fluctuations. This of course would replace equalizing opening 78.

It may be desirable to be able to dispense one liquid and not the other. This can be achieved by closing the discharge opening for the liquid to be retained and opening the other. Dispensing in the usual way will cause dispensing of one liquid through the corresponding discharge opening.

It will also be recognized that the embodiments desired are preferable for use by a user who lifts the dispenser before actuating it to dispense. In some circumstances the dispenser may be better used on a wall bracket or the like. Variations to the shape of the dispenser to accommodate such uses are within the scope of the invention.

It will now be recognized that the invention provides for two dissimilar liquids to be dispensed simultaneously into a common receiver such as the user's hand. The liquids will meet and this allows for a predetermined change to take place. For instance a change of colour or consistency to provide the user with a visual or tactile test that the liquids have mixed. Further, depending upon the liquids selected, the resulting material could have properties not found in either of the original liquids.

All such variations are within the scope of the invention as described and claimed.

I claim:

1. A dispenser for liquids having:

first and second resiliently flexible containers including respective downwardly opening outlets, the containers being arranged in side-by-side relationship;

a base sealingly coupled to the containers below the containers and having a dividing wall defining a pair of separate reservoirs, each of the reservoirs being under a respective one of the outlets with the outlets projecting into the reservoirs so that liquid from the containers will pool in the respective reservoirs until a level is reached when negative pressure built up in the container above the liquid creates equilibrium, the dividing wall defining an equalizing opening above said level of pooled liquid to equalize air pressure above the liquids in the reservoir; and the base further including a pair of dispensing outlets associated one with each of the reservoirs and located above the downwardly opening outlets, the dispensing outlets being positioned such that the pooled liquid is below the dispensing outlets whereby a user can apply a squeezing action to the dispenser to deflect the containers simultaneously to disturb said equilibrium and cause liquid to flow from the containers, through the respective reservoirs, and out through the dispensing outlets, and whereby upon discontinuing the squeezing action the resiliently deformable containers will draw air into the dispenser and equilibrium will be reestablished.

2. A dispenser for liquids having:

first and second resiliently deformable containers including respective downwardly opening necks, the containers being arranged in side-by-side relationships;

a base having a pair of tubes sealingly engaging the respective necks and forming extensions of the necks, the lower ends of the tubes defining outlets, and the base further including a dividing wall defining a pair of separate reservoirs, each of the reservoirs being under a respective one of the outlets with the outlets projecting into the respective reservoirs so that liquid from the containers will pool in the reservoirs until levels of liquids are reached balanced by negative pressures built up in the containers above the liquids to create equilibrium, the dividing wall defining an equalizing opening above said levels of pooled liquid to equalize air pressure above the liquids in the reservoir; and the base further including a pair of dispensing outlets associated one with each of the reservoirs and located above the outlets, the dispensing outlets being positioned such that the pooled liquids are below the respective dispensing outlets whereby a user can apply a squeezing action to the dispenser to deflect containers simultaneously to disturb said equilibrium and cause the liquids to flow from the containers, through the respective reservoirs, and out through the dispensing outlets, and whereby upon discontinuing the squeezing action the resiliently deformable containers will draw air into the dispenser and equilibrium will be reestablished.

3. A dispenser for liquids having:

a base defining a pair of separate reservoirs for containing pools of liquids to a selected level, the base having dispensing outlets above the reservoirs for discharging the liquids and including pressure equalizing structure to permit pressures in the reservoirs to remain substantially equal;

a pair of containers extending upwardly in side-by-side relationship above the base and coupled to the base, each of the containers opening downwardly in said respective reservoirs below said selected level to create negative pressure above the liquids in the containers resulting in a state of equilibrium; and means operable to disturb the equilibrium in the containers to discharge the liquids simultaneously out of the respective discharge openings.

4. A dispenser as claimed in claim 3 in which the containers have necks defining bottom outlets located below said selected level.

5. A dispenser as claimed in claim 3 in which the base includes tubes sealingly coupled to the containers to provide bottom outlets below the selected level.

6. A dispenser as claimed in claim 3 in which the base includes a receptacle defining the reservoirs and in insert above the reservoirs sealingly engaged with the base to contain the reservoirs, and in which the containers include necks and the insert includes tubes sealingly engaged on the respective necks so that liquids from the containers are contained in the respective reservoirs.

7. A dispenser as claimed in claim 3 in which the insert is coupled to the containers.

8. A dispenser as claimed in claim 3 in which the reservoirs are separated by a dividing wall.

9. A dispenser as claimed in claim 8 in which the equalizing structure is an opening in the dividing wall, the opening being above said selected level.

10. A dispenser as claimed in claim 8 in which the equalizing structure is valves in the dividing wall, the valves being above said selected level.

11. A dispenser as claimed in claim 8 in which equalizing structure is a portion of a limp material in the dividing wall to permit movement to permit pressures in the reservoirs to equalize.

* * * * *